US008936449B2

(12) United States Patent
Lee et al.

(10) Patent No.: US 8,936,449 B2
(45) **Date of Patent: *Jan. 20, 2015**

(54) HERMETIC COMPRESSOR AND MANUFACTURING METHOD THEREOF

(75) Inventors: Kangwook Lee, Seoul (KR); Bumdong Sa, Seoul (KR)

(73) Assignee: LG Electronics Inc., Seoul (KR)

( * ) Notice: Subject to any disclaimer, the term of this patent is extended or adjusted under 35 U.S.C. 154(b) by 84 days.

This patent is subject to a terminal disclaimer.

(21) Appl. No.: 13/338,605

(22) Filed: Dec. 28, 2011

(65) Prior Publication Data

US 2012/0171067 A1 Jul. 5, 2012

(30) Foreign Application Priority Data

Dec. 29, 2010 (KR) ..... 10-2010-0138168

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/10*** | (2006.01) |
| ***F04C 18/32*** | (2006.01) |

(Continued)

(52) U.S. Cl.

CPC ..... *F01C 21/10* (2013.01); *F04C 18/322* (2013.01); *F04C 23/008* (2013.01); *F04C 29/025* (2013.01); *F04C 29/06* (2013.01); *F04C 2240/40* (2013.01); *F04C 2240/804* (2013.01); *F04C 2270/12* (2013.01)

USPC ..... 418/63

(58) Field of Classification Search

USPC ..... 418/63, 66, 91–94, 102, 103, 228, 229, 418/183, 173–177, 270, DIG. 1; 417/356, 417/357, 410.1, 908

See application file for complete search history.

(56) References Cited

U.S. PATENT DOCUMENTS

| | | | | |
|---|---|---|---|---|
| 2,122,462 | A | 7/1938 | Fricke | 230/140 |
| 2,415,011 | A | 1/1947 | Hubacker | |

(Continued)

FOREIGN PATENT DOCUMENTS

| | | |
|---|---|---|
| CN | 101135309 | 3/2008 |
| EP | 0 526 145 A2 | 2/1993 |

(Continued)

OTHER PUBLICATIONS

Chinese Office Action dated Feb. 7, 2014. (translation).

(Continued)

*Primary Examiner* — Thai Ba Trieu
*Assistant Examiner* — Dapinder Singh
(74) *Attorney, Agent, or Firm* — Ked & Associates LLP

(57) ABSTRACT

A hermetic compressor is provided. The hermetic compressor includes a cylindrical shell; a stator fixed to an inner surface of the shell; a rotor rotatably installed with respect to the stator; a compression device combined with the rotor to be rotated together with the rotor; a stationary shaft including an eccentric portion around which the compression device is supported to be stationary with respect to a longitudinal direction thereof; an accumulator fixed to an inside of the shell in such a manner so as to seal an upper end of the shell and fixedly support a first end of the stationary shaft above the stator; a lower frame fixed to the inside of the shell, that fixedly supports a second end of the stationary shaft; an upper cap to seal an upper end of the accumulator; and a lower cap to seal a lower end of the shell.

20 Claims, 14 Drawing Sheets

(51) Int. Cl.

| | |
|---|---|
| ***F04C 23/00*** | (2006.01) |
| *F04C 29/02* | (2006.01) |
| *F04C 29/06* | (2006.01) |

(56) References Cited

U.S. PATENT DOCUMENTS

| | | | | |
|---|---|---|---|---|
| 2,420,124 | A | 5/1947 | Coulson | |
| 2,440,593 | A | 4/1948 | Miller | |
| 3,153,334 | A | 10/1964 | Vutz | |
| 4,624,630 | A | 11/1986 | Hirahara et al. | |
| 4,826,408 | A | 5/1989 | Inoue et al. | |
| 5,261,800 | A | 11/1993 | Sakae | |
| 5,295,788 | A | 3/1994 | Tajima et al. | |
| 5,374,171 | A | 12/1994 | Cooksey | |
| 5,542,831 | A | 8/1996 | Scarfone | |
| 6,213,732 | B1 | 4/2001 | Fujio | |
| 6,592,346 | B2 | 7/2003 | Bushnell | |
| 6,817,490 | B2 | 11/2004 | Petit | |
| 6,824,367 | B2 | 11/2004 | Matsumoto et al. | |
| 7,344,367 | B2 | 3/2008 | Manole | |
| 7,361,004 | B2 | 4/2008 | Hwang et al. | |
| 7,607,904 | B2 | 10/2009 | Masuda | |
| 2003/0072664 | A1 | 4/2003 | Bushnell | 418/63 |
| 2005/0031465 | A1 | 2/2005 | Dreiman et al. | |
| 2005/0201884 | A1 | 9/2005 | Dreiman | |
| 2006/0127256 | A1 | 6/2006 | Hwang et al. | 418/29 |
| 2006/0159570 | A1 | 7/2006 | Manole | 471/440 |
| 2009/0155111 | A1 | 6/2009 | Okaichi et al. | |
| 2010/0092322 | A1 | 4/2010 | Furusho et al. | |
| 2010/0322796 | A1 | 12/2010 | Ko | |

FOREIGN PATENT DOCUMENTS

| | | | |
|---|---|---|---|
| EP | 1 657 444 | A1 | 5/2006 |
| JP | 61-187591 | | 8/1986 |
| JP | 62-284985 | | 12/1987 |
| JP | 63-186988 | | 8/1988 |
| JP | 2000-283074 | | 10/2000 |
| JP | 2002-221156 | | 8/2002 |
| KR | 10-1998-043393 | | 9/1998 |
| KR | 10-1999-0012573 | | 2/1999 |
| KR | 10-0230999 | B1 | 11/1999 |
| KR | 10-1999-0084586 | A | 12/1999 |
| KR | 10-2000-0033611 | A | 6/2000 |
| KR | 20-2001-0002267 | A | 10/2001 |
| KR | 10-2010-0010441 | | 2/2010 |
| WO | WO 2010/010994 | A2 | 1/2010 |
| WO | WO 2010/010996 | | 1/2010 |

OTHER PUBLICATIONS

U.S. Office Action issued in U.S. Appl. No. 13/338,737 dated Dec. 31, 2013.
U.S. Office Action issued in U.S. Appl. No. 13/338,778 dated Jan. 15, 2014.
U.S. Office Action issued in U.S. Appl. No. 13/338,822 dated Jan. 15, 2014.
International Search Report and Written Opinion dated May 1, 2012. (PCT/KR2011/010108).
International Search Report and Written Opinion dated May 1, 2012. (PCT/KR2011/010110).
International Search Report and Written Opinion dated May 1, 2012. (PCT/KR2011/010166).
International Search Report and Written Opinion dated May 1, 2012 issued in Application No. PCT/KR2011/010111.
U.S. Office Action issued in U.S. Appl. No. 13/338,737 dated Aug. 28, 2013.
U.S. Office Action issued in U.S. Appl. No. 13/338,822 dated Sep. 9, 2013.
U.S. Office Action issued in U.S. Appl. No. 13/338,778 dated Sep. 11, 2013.
U.S. Office Action issued in U.S. Appl. No. 13/338,480 dated Dec. 2, 2013.
European Search Report dated Apr. 14, 2014. (2659142).
European Search Report dated Apr. 14, 2014. (2659144).
U.S. Office Action issued in U.S. Appl. No. 13/338,737 dated Apr. 24, 2014.
U.S. Office Action issued in U.S. Appl. No. 13/338,480 dated May 13, 20124.
European Search Report issued in Application No. 11852747.2 dated Jun. 11, 2014.
Notice of Allowance dated Jul. 21, 2014, issued in U.S. Appl. No. 13/338,737.
Notice of Allowance dated Aug. 6, 2014, issued in U.S. Appl. No. 13/338,822.
Notice of Allowance dated Sep. 4, 2014, issued in U.S. Appl. No. 13/338,480.
European Search Report dated Sep. 8, 2014, issued in Application No. 11853555.8.
Office Action dated Oct. 1, 2014, issued in U.S. Appl. No. 13/338,778.
Chinese Office Action dated Sep. 19, 2014, issued in Application No. 201110460468.5 (with English translation).

HERMETIC COMPRESSOR AND MANUFACTURING METHOD THEREOF

CROSS-REFERENCE TO RELATED APPLICATIONS

The present disclosure relates to subject matter contained in priority Korean Application No. 10-2010-0138168, filed on Dec. 29, 2010, which is herein expressly incorporated by reference in its entirety.

BACKGROUND

1. Field of the Disclosure

The present disclosure relates to a hermetic compressor, and more particularly, to a hermetic compressor capable of modularizing an accumulator with a compressor shell.

2. Description of the Related Art

In general, a hermetic compressor may be installed with a drive motor for generating a driving force into an internal space of the hermetically sealed shell and a compression unit being operated in combination with the drive motor to compress refrigerant. Furthermore, the hermetic compressor may be divided into a reciprocating compressor, a scroll compressor, a rotary compressor, and an oscillating compressor according to the type of compressing refrigerant. The reciprocating, scroll, and rotary compressors can use a rotational force of the drive motor, but the oscillating compressor can use a reciprocating motion of the drive motor.

Of the foregoing hermetic compressors, a drive motor of the hermetic compressor using a rotational force may be provided with a crank shaft for transferring a rotational force of the drive motor to the compression unit. For instance, the drive motor of the rotary type hermetic compressor (hereinafter, rotary compressor) may include a stator fixed to the shell, a rotor inserted into the stator with a predetermined gap to be rotated in interaction with the stator, and a crank shaft combined with the rotor to transfer a rotational force of the drive motor to the compression unit while being rotated together with the rotator. In addition, the compression unit may include a cylinder forming a compression space, a vein dividing the compression space of the cylinder into a suction chamber and a discharge chamber, and a plurality of bearing members forming a compression space together with the cylinder while supporting the vein. The bearing member(s) may be disposed at a side of the drive motor or disposed at both sides thereof, respectively, to support in both axial and radial directions such that the crank shaft can be rotated with respect to the cylinder.

Furthermore, an accumulator, which is connected to a suction port of the cylinder to divide refrigerant inhaled into the suction port into gas refrigerant and liquid refrigerant and inhale only the gas refrigerant into a compression space, may be installed at a side of the shell.

The capacity of the accumulator may be determined according to the capacity of the compressor or cooling system, and the accumulator may be fixed by a band, a clamp, or the like at an outer portion of the shell, and communicated with an suction port of the cylinder through an L-shaped suction pipe to be fixed to the shell.

However, in case of the foregoing rotary compressor in the related art, the accumulator may be installed at an outer portion of the shell, and thus the size of the compressor including the accumulator may be increased, thereby causing a problem of increasing the size of an electrical product employing the compressor.

Furthermore, in a rotary compressor in the related art, the accumulator may be connected to a separate suction pipe at the outside of the shell, and thus the assembly works of the shell and accumulator may be isolated from each other, thereby complicating the assembly process while increasing the number of assembly processes. Moreover, the number of connecting portions may be increased as both sides of the accumulator are connected to the shell through refrigerant pipes, respectively, thereby also causing a problem of increasing the possibility of refrigerant leakage.

Furthermore, in a rotary compressor in the related art, an area occupied by the compressor may be increased because the accumulator is installed at the outside of the shell, thereby also causing a problem of limiting the design flexibility when the compressor is mounted on an outdoor unit of the cooling cycle apparatus, or the like.

SUMMARY OF THE DISCLOSURE

An object of the present invention is to provide a hermetic compressor in which an accumulating chamber of the accumulator is formed by using an internal space of the shell and easy to manufacture.

Another object of the present invention is to provide a manufacturing method of hermetic compressor capable of simplifying the assembly process of the compressor In order to accomplish the objective, there is provided a hermetic compressor, comprising: a cylindrical shell; a stator fixed to inner surface of the shell; a rotor rotatably installed with respect to the stator; a compression unit combined with the rotor to be rotated together with the rotor; a stationary shaft including an eccentric portion around which the compression unit is supported stationary with respect to a longitudinal direction thereof; an accumulator fixed to inside of the shell in such a manner sealing the upper end of the shell and fixedly supporting one end of the stationary shaft above the stator; a lower frame fixed to inside of the shell and fixedly supporting the other end of the stationary shaft; an upper cap to seal the upper end of the accumulator; and a lower cap to seal the lower end of the shell.

Furthermore, in order to accomplish the objective of the present invention, there is provided a hermetic compressor, comprising: a container within which a stator is fixed to; a stationary shaft which rotatably supports a compression unit combined with the rotor stationary with respect to a longitudinal direction thereof; and a first and second member to fix the stationary shaft inside of the container; wherein the first and second members are fixed to inside of the container with the compression unit therebetween.

Furthermore, in order to accomplish the objective of the present invention, there is provided a manufacturing method of a hermetic compressor, comprising the steps of: resting a stator on an upper end of a lower frame; fixing the lower frame and the stator to inside of a cylindrical shell by a shrink fit; temporarily assembling a gap-maintainer into the stator; inserting a rotor assembly coupled to a stationary shaft into the gap-maintainer; coupling an accumulator to upper outer circumferential surface of the stationary shaft; fixing the accumulator to the inner surface of the shell; fixing the stationary shaft to the accumulator; fixing a lower cap to the lower end of the shell; and fixing a upper cap to the upper portion of the accumulator.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a hermetic compressor according to an embodiment of the present invention will be described in detail with reference to the accompanying drawings.

Figure 1:
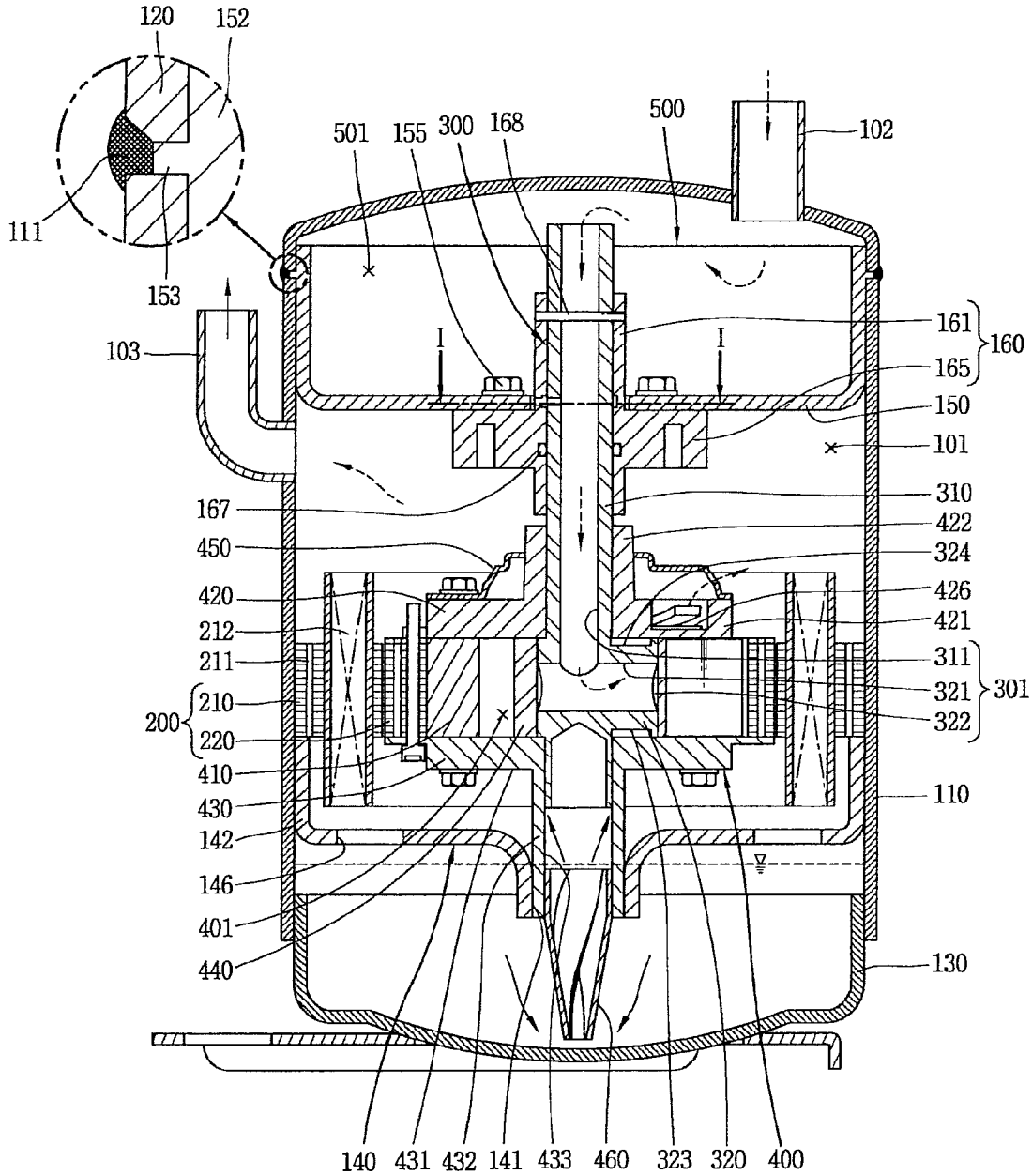
FIG. 1 is a cross-sectional view illustrating an embodiment of a hermetic compressor according to the present disclosure.
Figure 2:
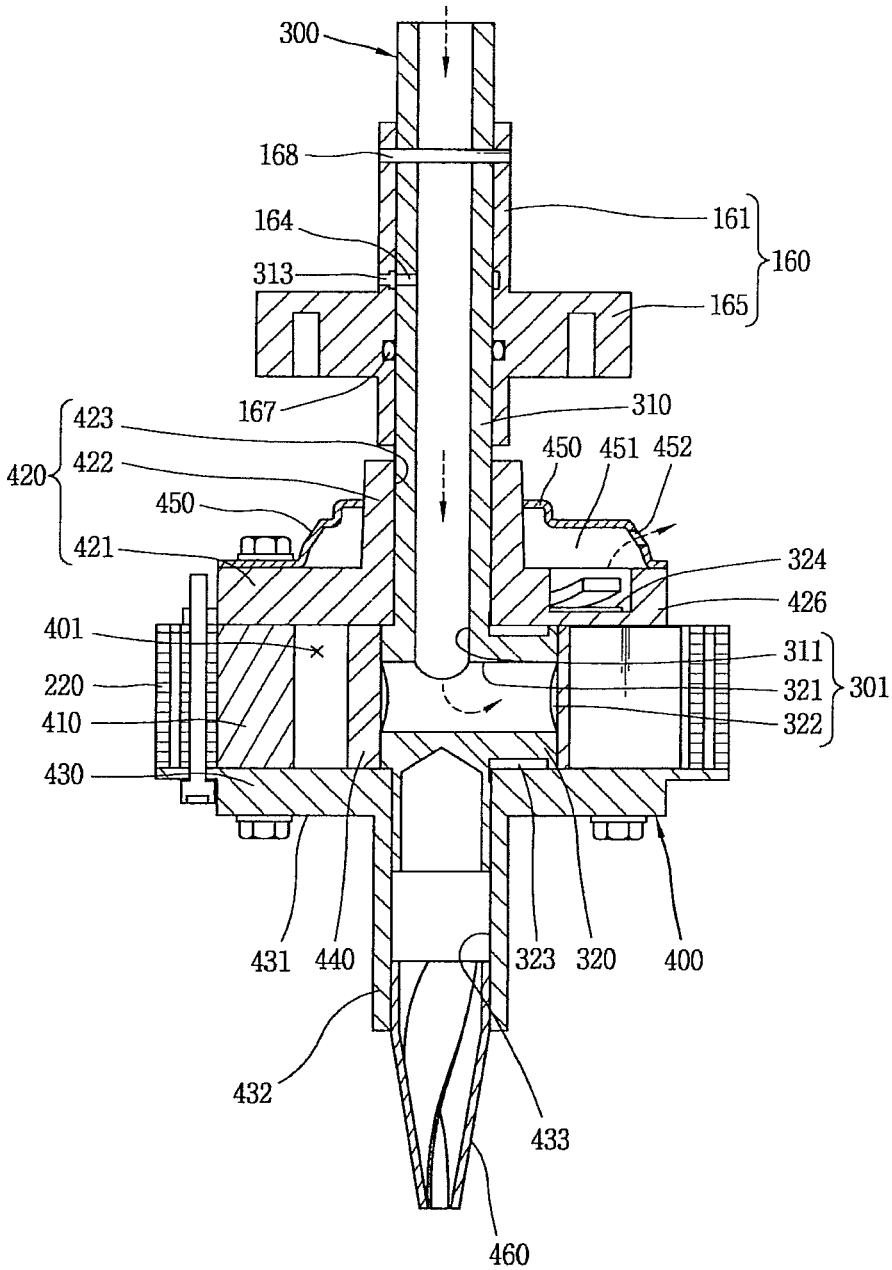
FIG. 2 is a cross-sectional view illustrating a coupling relation between a stationary shaft and a compression unit in the hermetic compressor of FIG. 1.
Figure 3:
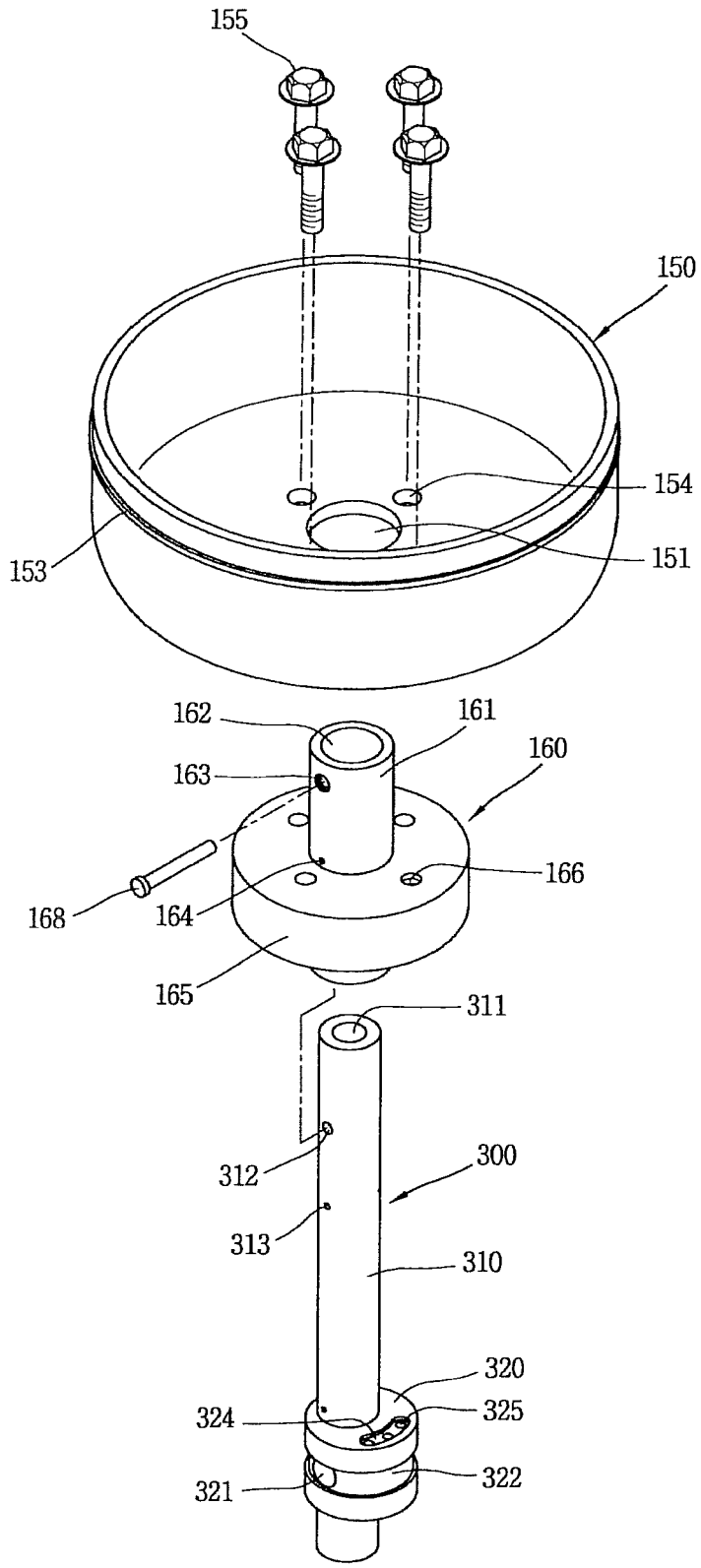
FIG. 3 is an exploded perspective view illustrating an accumulator frame and a stationary shaft in the hermetic compressor of FIG. 1.

As illustrated in FIGS. 1 through 3, a hermetic compressor according to the present invention may be installed with a drive motor 200 generating a rotational force to an internal space 101 of a hermetically sealed shell 100, and installed with a stationary shaft 300 fixed to the internal space 101 of the shell 100 at the center of the drive motor 200, and rotatably combined with a cylinder 410 combined with a rotor 220 of the drive motor 200 to be rotated at the stationary shaft 300, and installed with an accumulator 500 provided with a predetermined accumulating chamber 501 separated from the internal space 101 of the shell 100 to be combined with the stationary shaft 300 at the internal space 101 of the shell 100.

The shell 100 may include a body shell 110 installed with the drive motor 200, an upper cap 120 forming an upper surface of the accumulator 500 while covering an upper opening end (hereinafter, first opening end) 111 of the body shell 110, and a lower cap 130 covering a lower opening end (hereinafter, second opening end) 112 of the body shell 110.

The body shell 110 may be formed in a cylindrical shape, and a stator 210 which will be described later may be fixed and combined with a middle portion of the body shell 110 in a shrink-fitting manner. Furthermore, a lower frame 140 supporting a lower bearing 430, which will be described later, in a radial direction as well as the stator 210 may be shrink-fitted and fixed to the body shell 110 at a lower portion of the stator 210. The lower frame 140 may be formed with a bearing hole 141 into the center of which the lower bearing 430 is rotatably inserted to support a stationary shaft 300, which will be described later, in a radial direction, and an edge of the lower frame 140 may be bent and formed with a fixing portion allowing an outer circumferential surface thereof to be closely adhered to the body shell 110. An outer front end surface of the lower frame 140, namely, an end of the fixing portion 142, may be closed adhered to a lower surface of the stator 210 and fixed to the body shell 110 to support the stator 210 in an axial direction.

Figure 4:
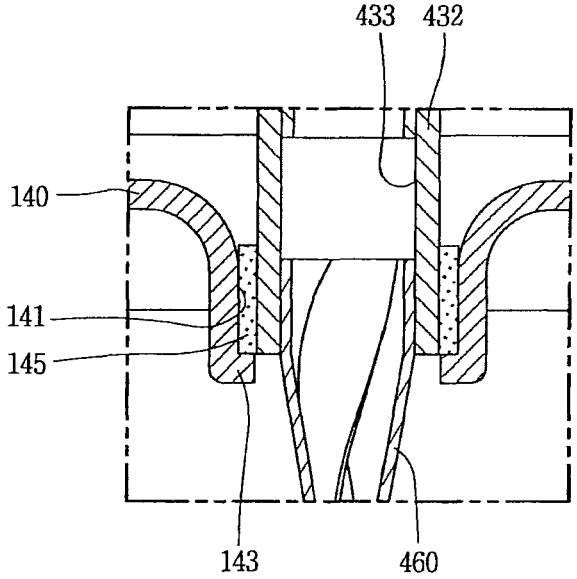
FIG. 4 is a cross-sectional view illustrating an example in which a bearing member is provided between a lower frame and a lower bearing in the hermetic compressor of FIG. 1.

Here, the lower frame 140 may be made of a metal plate or made of a casting. When the lower frame 140 is made of a metal plate, a separate bearing member 145 such as a ball bearing or bush may be preferably installed thereon to lubricate between the lower frame 140 and the lower bearing 430 as illustrated in FIG. 4. However, when the lower frame 140 is made of a casting, a bearing hole 141 of the lower frame 140 can be precision processed and therefore a separate bearing member may be required to be installed. When a bearing member 145 is installed between the lower frame 140 and the lower bearing 430, a bearing support portion 143 may be preferably bent and formed to support the bearing member 145 at an end of the bearing hole 141 of the lower frame 140 as illustrated in FIG. 4.

An accumulator frame 150 forming a lower surface of the accumulator 500 may be combined with an upper end of the body shell 110.

Figure 5:
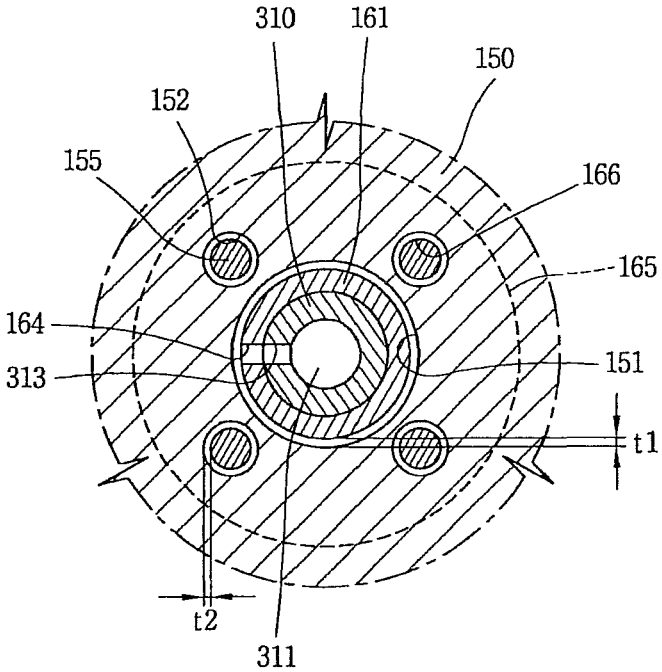
FIG. 5 is a cross-sectional view taken along the line I-I of FIG. 1.

The accumulator frame 150 may be formed with a bush hole 151 through the center of which a stationary bush (upper bush) 160 which will be described later to be penetrated and combined therewith. As illustrated in FIG. 5, an inner diameter of the bush hole 151 may be preferably formed larger than an outer diameter of the shaft receiving portion 161 of the stationary bush 160 which will be described later to have a clearance (t1) during the process of centering the stationary shaft 300 which will be described later.

Furthermore, a through hole 152 for fastening the stationary bush 160 with a bolt 155 may be formed at the periphery of the bush hole 151 as illustrated in FIG. 5. The through hole 152 may be preferably formed larger than a diameter of the bolt 155 or a diameter of the fastening hole 166 provided in the stationary bush 160 to have a clearance (t2) during the process of centering the stationary shaft 300 as in the bush hole 151.

Furthermore, an edge of the accumulator frame 150 may be formed with a stationary end portion 153 that is bent at a length overlapped with the body shell 110 and a joint end of the upper cap 120, namely, a length that can be inserted to an inner circumferential surface of the upper cap 120. Furthermore, the stationary end portion 153 of the accumulator frame 150 may be closely adhered to an inner circumferential surface of the body shell 110 and an inner circumferential surface of the upper cap 120 to be welded and combined with the body shell 110 and a joint end of the upper cap 120 to weld the body shell 110, the upper cap 120, and the accumulator frame 150 at once and lengthen a sealing length thereof, thereby enhancing the sealability of the shell 100. Here, a fixing protrusion 154 may be formed on an outer circumferential surface of the stationary end portion 153 of the accumulator frame 150 to be interposed between the body shell 110 and a joint end of the upper cap 120.

Figure 12:
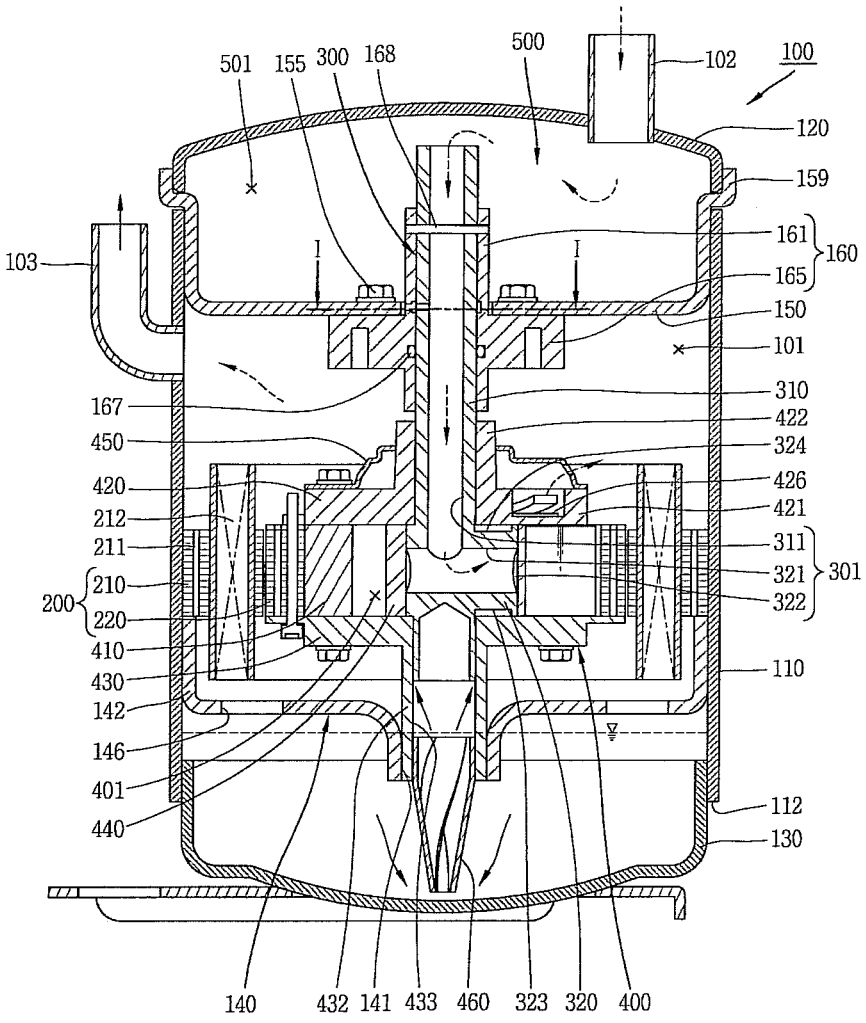
FIG. 12 is a cross-sectional view illustrating another embodiment of a hermetic compressor according to the present disclosure.
Figure 13:
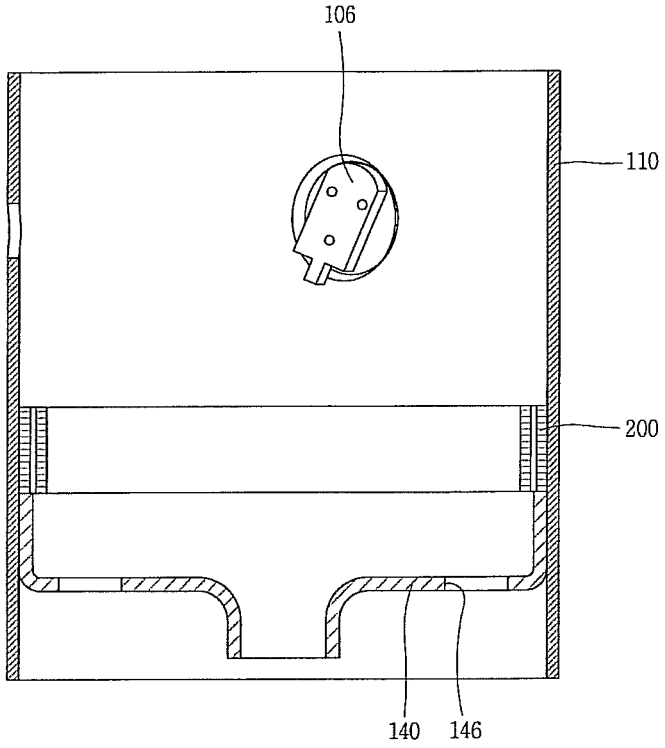
FIGS. 13 to 16 are the drawings showing the manufacturing steps of the embodiment of FIG. 1.
Figure 14:
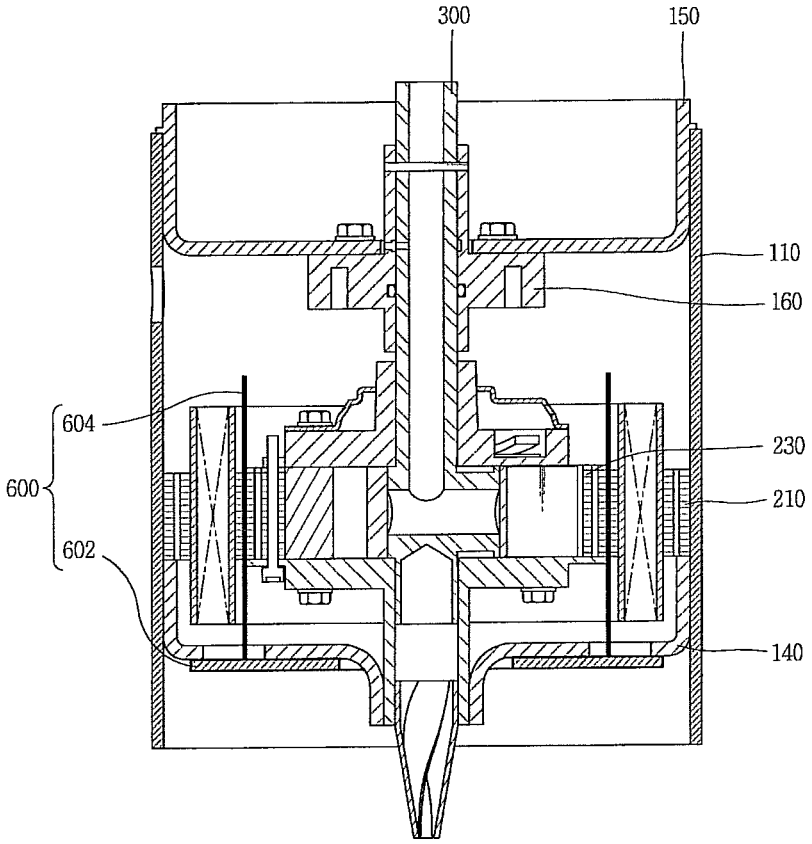

Here, the upper cap is not limited to be fixed as show, instead the upper cap 120 may be fixed to inner circumferential surface to the accumulator frame 150 as shown in FIG. 12. In this case, the accumulator frame 150 includes a extended portion 159 in its open end, thereby the upper cap may be more securely fixed to the accumulator frame 150.

The stationary bush 160 may include a shaft receiving portion 161 inserted into the bush hole 151 of the accumulator frame 150, and a flange portion 165 extended and formed in a radial direction at the middle of a circumferential surface of the shaft receiving portion 161.

Figure 6:
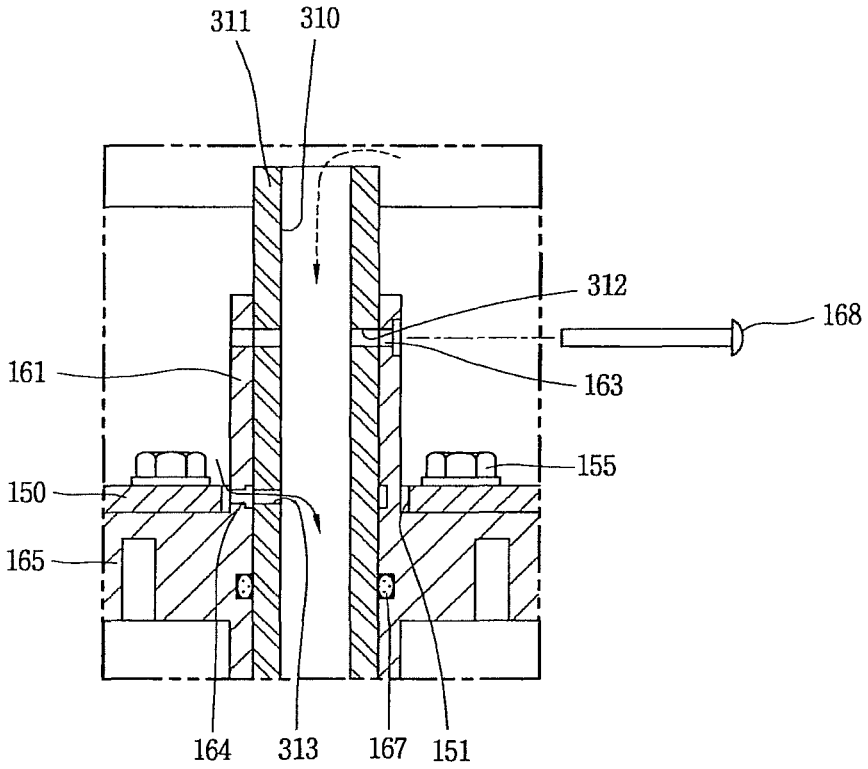
FIG. 6 is a cross-sectional view illustrating the fixing structure of a stationary shaft in the hermetic compressor of FIG. 1.

The shaft receiving portion 161 may be formed of a shaft receiving hole 162 through the center of which the stationary shaft 300 is penetrated and inserted in a radial direction, and a sealing member 167 for sealing between the accumulating chamber 501 of the accumulator 500 and the internal space 101 of the shell 100 may be pressed and combined with the middle of the shaft receiving portion 161. Furthermore, as illustrated in FIGS. 5 and 6, a pin fixing hole 163 may be formed at an upper end side of the shaft receiving portion 161 to insert a fixing pin 168 for fastening and fixing the stationary shaft 300. Here, the stationary bush 160 and the stationary shaft 300 may be fixed by using a fixing bolt other than the foregoing fixing pin 168, or fixed by using a fixing ring, according to circumstances. Furthermore, an oil drain hole 164 for collecting oil separated from the accumulator 500 into a compression space 401 through a refrigerant suction passage 301 of the stationary shaft 300 may be formed at the middle of the shaft receiving portion 161, namely, a portion adjacent to the flange portion 165.

The flange portion 165 may be preferably formed in such a manner that the radial directional width is formed larger than a width at which the shaft receiving portion 161 can be moved in a radial direction, thereby allowing a clearance when the stationary bush 160 performs a centering operation together with the stationary shaft 300. A plurality of fastening holes 166 may be formed at the flange portion 165 to correspond to the through hole 152 of the accumulator frame 150, and the fastening hole 166 may be formed smaller than a diameter of the through hole 152.

An edge of the upper cap 120 may be bent to face a first opening end 111 of the body shell 110 to be welded and combined with the first opening end 111 of the body shell 110 together with the fixing portion 142 of the accumulator frame 150. Furthermore, a suction pipe 102 for guiding refrigerant to the accumulator 500 during the cooling cycle may be penetrated and combined with the upper cap 120. The suction pipe 102 may be preferably eccentrically disposed to one side of the upper cap 120, namely, not to concentrically correspond to the refrigerant suction passage 301 of the stationary shaft 300 which will be described later, thereby preventing liquid refrigerant from being inhaled into the compression space 401. Furthermore, a discharge pipe 103 for guiding refrigerant discharged into the internal space 101 of the shell 100 from the compression unit 400 may be penetrated and combined with a body shell 110 between the stator 210 and the accumulator frame 150.

An edge of the lower cap 130 may be bent to be welded and combined with a second opening end 112 of the body shell 110.

As illustrated in FIG. 1, the drive motor 200 may include a stator 210 fixed to the shell 100 and a rotor 220 rotatably disposed at an inner portion of the stator 210.

The stator 210 may be laminated with a plurality of ring-shaped stator sheets at a predetermined height, and a coil 230 may be wound around a teeth portion provided at the inner circumferential surface thereof. Furthermore, the stator 210 may be shrink-fitted to be fixed and combined with the body shell 110 in an integrated manner, and a front end surface of the lower frame 140 may be closely adhered and fixed to a lower surface of the stator 210.

An oil collecting hole 211 may be penetrated and formed at an edge of the stator 210 to gather oil being collected into the internal space 101 of the shell 100 through the stator 210 in the lower cap 130. The oil collecting hole 211 of the stator 210 may be communicated with an oil collecting hole 146 of the lower frame 140.

The rotor 220 may be disposed at an inner circumferential surface of the stator 210 with a predetermined gap and combined with the cylinder 410 which will be described later at the center thereof. The rotor 220 and cylinder 410 may be combined with an upper bearing plate (hereinafter, abbreviated as an "upper bearing") 420 or lower bearing plate (hereinafter, abbreviated as a "lower bearing") 430, which will be described later, with a bolt, and the rotor 220 and cylinder 410 may be molded in an integrated manner by using a sintering process.

As illustrated in FIGS. 1 through 3, the stationary shaft 300 may include a shaft portion 310 having a predetermined length in an axial direction and both ends of which are fixed to the shell 100, and an eccentric portion 320 eccentrically extended at the middle of the shaft portion 310 in a radial direction and accommodated in the compression space 401 of the cylinder 410 to vary a volume of the compression space 401. Here, the shaft portion 310 may be formed such that the center of the shaft corresponds to a rotational center of the cylinder 410 or a rotational center of the rotor 220 or a radial center of the stator 210 or a radial center of the shell 100, whereas the eccentric portion 320 may be formed such that the center of the shaft is eccentrically located with respect to a rotational center of the cylinder 410 or a rotational center of the rotor 220 or a radial center of the stator 210 or a radial center of the shell 100.

An upper end of the shaft portion 310 may be inserted into the accumulating chamber 501 of the accumulator 500 whereas a lower end of the shaft portion 310 may be penetrated in an axial direction and rotatably combined with the upper bearing 420 and lower bearing 430 to support the upper bearing 420 and lower bearing 430 in a radial direction.

A first suction guide hole 311 an upper end of which is communicated with the accumulating chamber 501 of the accumulator 500 to form the refrigerant suction passage 301 may be formed at an inner portion of the shaft portion 310 with a predetermined depth in an axial direction, nearly to a lower end of the eccentric portion 320, and a second suction guide hole 321 an end of which is communicated with the first suction guide hole 311 and the other end of which is communicated with the compression space 401 to form the refrigerant suction passage 301 together with the first suction guide hole 311 may be penetrated and formed at the eccentric portion 320 in a radial direction.

Furthermore, as illustrated in FIG. 6, a pin hole 312 may be penetrated and formed at an upper side of the shaft portion 310, particularly a portion corresponding to the pin fixing hole 163 of the stationary bush 160, in a radial direction to allow the fixing pin 168 to pass therethrough, and an oil drain hole 313 for collecting oil congested in the accumulator 500 may be formed at a lower side of the pin hole 312, namely, at a height of the bush hole 151 positioned lower than a bottom surface of the accumulator frame 150, to communicate with the first suction guide hole 311.

Figure 7:
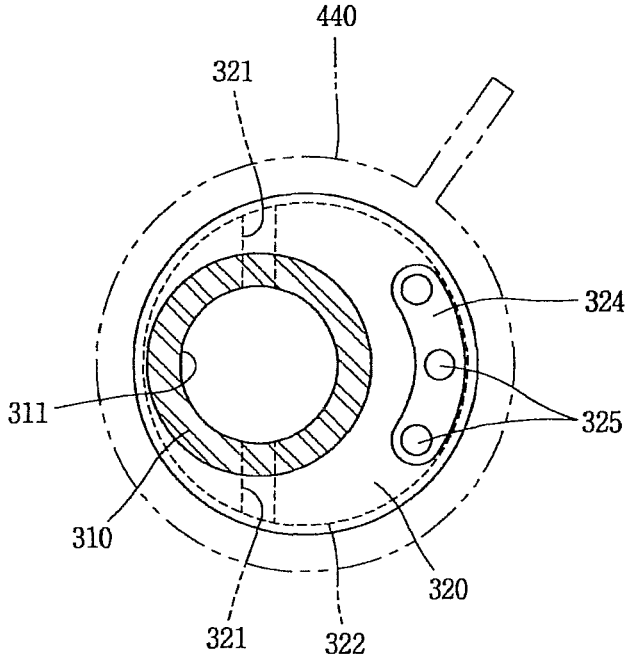
FIG. 7 is a plan view illustrating an eccentric portion of the stationary shaft in the hermetic compressor of FIG. 1.

The eccentric portion 320 may be formed in a disc shape having a predetermined thickness as illustrated in FIG. 7, and thus eccentrically formed with respect to the shaft center of the shaft portion 310 in a radial direction. Here, an eccentric amount of the eccentric portion 320 may be sufficiently large according to the capacity of the compressor as the shaft portion 310 is fixed and combined with the shell 100.

Furthermore, the second suction guide hole 321 constituting the refrigerant suction passage 301 together with the first suction guide hole 311 may be penetrated and formed at an inner portion of the eccentric portion 320 in a radial direction. A plurality of second suction guide holes 321 may be penetrated and formed in a straight line as illustrated in the drawing, but according to circumstances, the second suction guide hole 321 may be penetrated and formed only in one direction with respect to the first suction guide hole 311.

A suction guide groove 322 may be formed in a ring shape at an outer circumferential surface of the eccentric portion 320 to communicate refrigerant all the time with the a suction port 443 of the roller vein 440 which will be described later through the second suction guide hole 321. However, according to circumstances, the suction guide groove 322 may be formed at an inner circumferential surface of the roller vein 440, or may be formed at both an inner circumferential surface of the roller vein 440 and an outer circumferential surface of the eccentric portion 320. Furthermore, the suction guide groove 322 may not be necessarily required to be a ring shape but may be also formed in a long circular arc shape in a circumferential direction.

Figure 8:
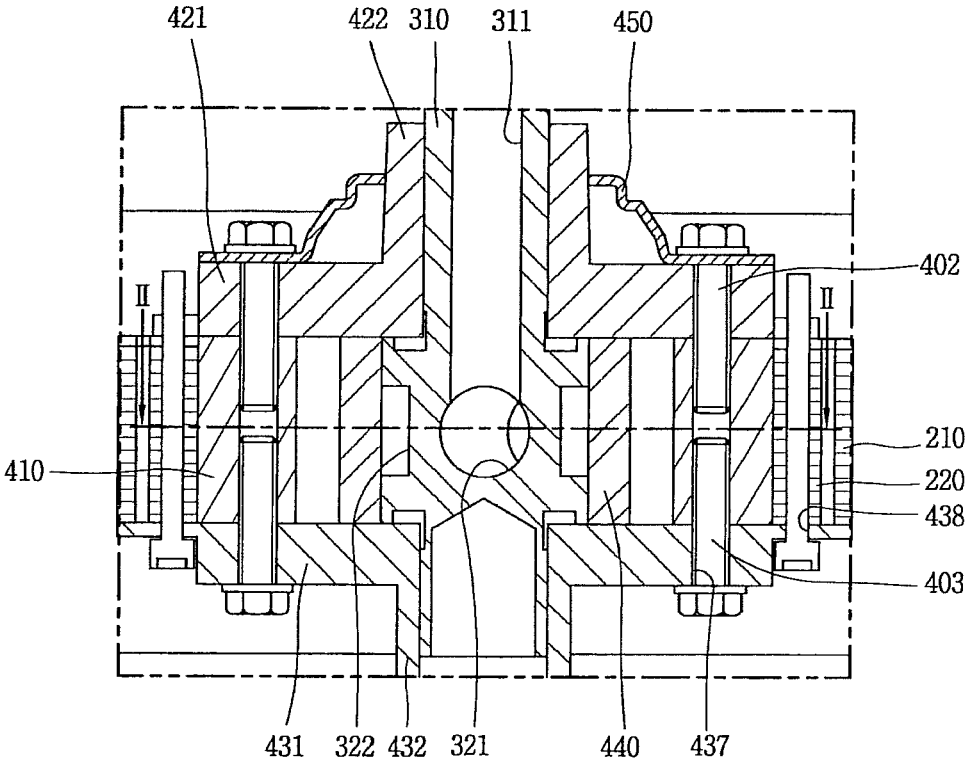
FIG. 8 is a cross-sectional view illustrating a compression unit in the hermetic compressor of FIG. 1.
Figure 9:
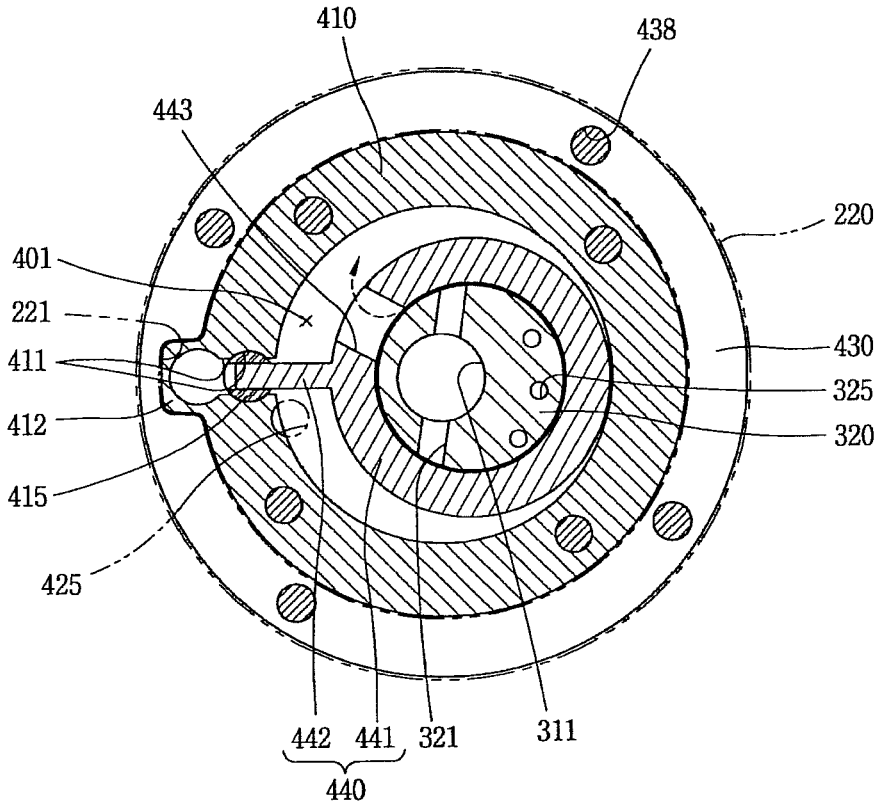
FIG. 9 is a cross-sectional view taken along the line II-II of FIG. 8.

The compression unit 400 may be combined with the eccentric portion 320 of the stationary shaft 300 to compress refrigerant while being combined and rotated together with the rotor 220. As illustrated in FIGS. 8 and 9, the compression unit 400 may include a cylinder 410, an upper bearing 420 and a lower bearing 430 combined with both sides of the cylinder 410 to form the compression space 401, and a roller vein 440 provided between the cylinder 410 and the eccentric portion 320 to compress refrigerant while varying the compression space 401.

The cylinder 410 may be formed in a ring shape to form the compression space 401 therewithin, and a rotational center of the cylinder 410 may be provided to correspond to an axial center of the stationary shaft 300. Furthermore, a vein slot 411 into which the roller vein 440 is slidably inserted in a radial direction while being rotated may be formed at a side of the cylinder 410. The vein slot may be formed in various shapes according to the shape of the roller vein. For example, a rotation bush 415 should be necessarily provided in the vein slot 411 such that the vein portion 442 can be rotationally moved in the vein slot 411 when a roller portion 441 and a vein portion 442 of the roller vein 440 are formed in an integrated manner as illustrated in FIG. 9, whereas the vein slot 411 may be formed in a slide groove shape such that the vein portion 442 can be slidably moved in the vein slot 411 when the roller portion 441 and vein portion 442 are rotatably combined with each other.

Furthermore, an outer circumferential surface of the cylinder 410 may be inserted into the rotor 220 to be combined therewith in an integrated manner. To this end, the cylinder 410 may be pressed to the rotor 220 or fastened to the upper bearing 420 or lower bearing 430 using fastening bolts 402, 403.

Here, when the cylinder 410 and upper bearing 420 are fastened by the lower bearing 430, an outer diameter of the lower bearing 430 may be formed larger than that of the cylinder 410 whereas an outer diameter of the upper bearing 420 may be formed to be approximately similar to that of the cylinder 410. Furthermore, a first through hole 437 for fastening the cylinder 410 and a second through hole 438 for fastening the rotor 220 may be formed, respectively, on the lower bearing 430. The first through hole 437 and second through hole 438 may be formed on radially different lines to enhance the fastening force but may be also formed on the same line by taking the assemblability into consideration. A fastening bolt 402 passing through the lower bearing 430 to be fastened with a lateral surface of the cylinder 410 and a fastening bolt 403 passing through the upper bearing 420 to be fastened with another lateral surface of the cylinder 410 may be formed to have the same fastening depth.

Figure 10:
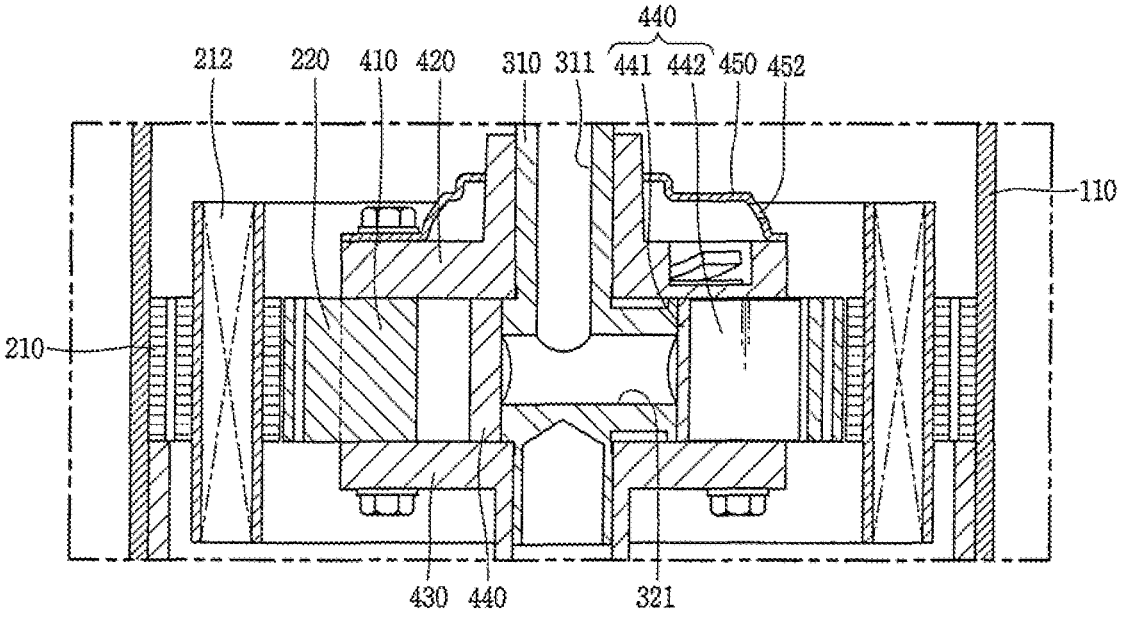
FIG. 10 is a cross-sectional view illustrating another embodiment of a coupling relation between a cylinder and a rotor in the hermetic compressor of FIG. 1.

Meanwhile, the cylinder 410 may be molded together with the rotor 220 in an integrated manner as illustrated in FIG. 10. For example, the cylinder 410 and rotor 220 may be molded in an integrated manner through a powder metallurgy or die casting process. In this case, the cylinder 410 and rotor 220 may be formed with the same material, and may be also formed with different materials. When the cylinder 410 and rotor 220 are formed with different materials, the cylinder 410 may be formed with a material having a relatively excellent abrasion resistance compared to the rotor 220 by taking the abrasion resistance of the cylinder 410 into consideration. Furthermore, when the cylinder 410 and rotor 220 are formed in an integrated manner, the upper bearing 420 and lower bearing 430 may be formed to have the same or smaller outer diameter as or than that of the cylinder 410 as illustrated in FIG. 10.

Furthermore, as illustrated in FIG. 9, a protrusion portion 412 and a groove portion 221 may be formed on an outer circumferential surface of the cylinder 410 and an inner circumferential surface of the rotor 220, respectively, (a protrusion portion on the cylinder and a groove portion on the rotor in the drawing) to enhance a combining force between the cylinder 410 and the rotor 220 as illustrated in FIG. 9. Furthermore, the vein slot 411 may be formed within a range of a circumferential angle formed with the protrusion portion 412 of the cylinder 410. Furthermore, a plurality of protrusion portions and groove portions may be formed thereon. When a plurality of protrusion portions and groove portions are formed thereon, it may be preferable that they are formed at the same interval along the circumferential direction to cancel out the magnetic unbalance.

Figure 11:
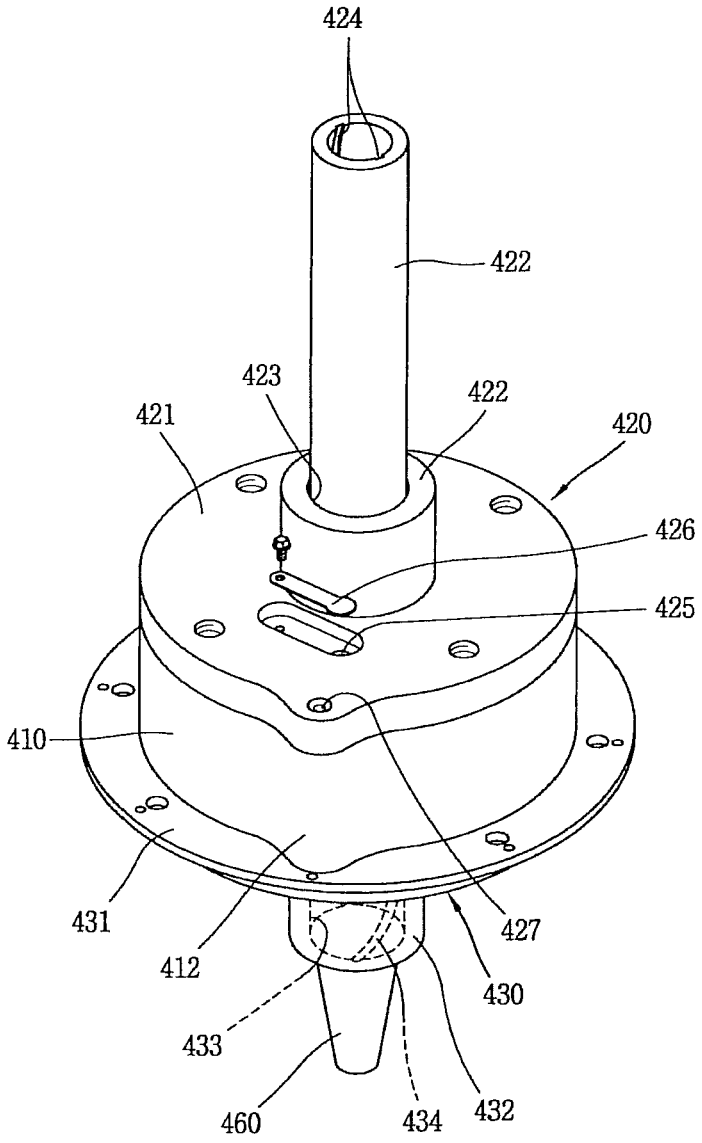
FIG. 11 is a perspective view illustrating a compression unit in the hermetic compressor of FIG. 1.

As illustrated in FIG. 11, the upper bearing 420 may be formed such that a shaft receiving portion 422 supporting the shaft portion 310 of the stationary shaft 300 in a radial direction is protruded upward at a predetermined height at the center of an upper surface of the stationary plate portion 421. Here, the rotor 220, the cylinder 410, and a rotating body including the upper bearing 420 and the lower bearing 430 which will be described later may have a rotational center corresponding to an axial center of the stationary shaft 300, and thus the rotating body can be efficiently supported even though the shaft receiving portion 422 of the upper bearing 420 or the shaft receiving portion 432 of the lower bearing 430 do not have a long length.

The stationary plate portion 421 may be formed in a disc shape to be fixed to an upper surface of the cylinder 410, and a shaft receiving hole 423 of the shaft receiving portion 422 may be penetrated and formed in a radial direction to be rotatably combined with the stationary shaft 300. An oil groove 424 which will be described later may be formed in a spiral shape at an inner circumferential surface of the shaft receiving hole 423.

A discharge port 425 may be formed at a side of the shaft receiving portion 422 to communicate with the compression space 401, and a discharge valve 426 may be formed at an outlet end of the discharge port 425. Furthermore, a muffler 450 for reducing the discharge noise of refrigerant being discharged through the discharge port 425 may be combined with an upper side of the upper bearing 420.

A hermetic compressor having the foregoing configuration according to the present invention will be operated as follows.

In other words, when the rotor 220 is rotated by applying power to the stator 210 of the drive motor 200, the cylinder 410 combined with the rotor 220 through the upper bearing 420 or lower bearing 430 is rotated with respect to the stationary shaft 300. Then, the roller vein 440 slidably combined with the cylinder 410 generates a suction force while the roller vein 440 divides the compression space 401 of the cylinder 410 into a suction chamber and a discharge chamber.

Then, refrigerant is inhaled into the accumulating chamber 501 of the accumulator 500 through the suction pipe 102, and the refrigerant is divided into gas refrigerant and liquid refrigerant in the accumulating chamber 501 of the accumulator 500, and the gas refrigerant is inhaled into the suction chamber of the compression space 401 through the first suction guide hole 311 and second suction guide hole 321 of the stationary shaft 300, the suction guide groove 322, and the suction port 443 of the roller vein 440. The refrigerant inhaled into the suction chamber is compressed while being moved to the discharge chamber by the roller vein 440 as the cylinder 410 continues to be rotated, and discharged to the internal space 101 of the shell 100 through the discharge port 425, and the refrigerant discharged to the internal space 101 of the shell 100 repeats a series of processes to be discharged to a cooling cycle apparatus through the discharge pipe 103. At this time, oil in the lower cap 130 is pumped by the oil feeder 460 provided at a lower end of the lower bearing 430 while the lower bearing 430 is rotated at high speed together with the rotor 220, and passed sequentially through the oil groove 434 of the lower bearing 430, the bottom oil pocket 323, the oil through hole 325, the top oil pocket 324, the oil groove 424 of the upper bearing 420, and the like, to be supplied to each sliding surface.

Here, the assembly sequence of a compressor will be described below referring to FIGS. 13 to 16.

Firstly, a cylindrical shell 110 is prepared using a metal plate. Also, the stator 210 and the lower frame 140 are prepared, respectively, and then the lower frame 140 is rested on the upper end of the stator 210. In this state, the stator 210 and the lower frame 140 are fastened to inner circumferential surface of the shell 11 by a shrink fit with the stator 210 and the lower frame 140 supported by a jig (not shown). That is, the stator 210 and the lower frame 140 are fixed to inner circumferential surface of the shell at the same time, which facilitates fastening the stator 210 and the lower frame 140 to the shell 110 and prevent the stator from being shifted from its desired position while fastening the stator 210 and the lower frame 140 to the shell 110.

A terminal 106 is attached to inner side of the shell after completion of the stator 210 and the lower frame 140 are fastened to the shell.

Then, the gap maintainer 600 is inserted into inner side of the stator via the oil collecting holes 146 formed on the bottom surface of the lower frame 140. The gap maintainer 600 includes a disk shape base 602 and a plurality of gap liners 604 on the upper surface of the base 602, wherein the thickness of the gap liner 604 corresponds to a desired gap between the stator 210 and the rotor 220. Therefore, the gap liner 604 keeps the desired gap between the stator 210 and the rotor 220 while installing the rotor into the stator.

The stationary shaft 300 is installed with the gap maintainer 600 inserted. Here, the lower end of the stationary shaft 300 is fixed to the lower frame 140, and the upper end of the stationary shaft 300 is indirectly fixed to inner surface of the shell by the accumulator frame 150. The fastening steps of the upper end of the stationary shaft 300 to the shell are explained as below.

First, the accumulator frame 150 is temporarily assembled to the upper portion of the stationary shaft 300 before inserting the stationary shaft 300 into the shell. In this state, the stationary shaft 300 is fixed to the lower frame, wherein at least the lower end of the stationary shaft 300 is centered with respect to the stator by the gap maintainer, which enables to fix the stationary shaft 300 to the lower frame without additional centering work.

Then, the stationary bush 160 is coupled to the accumulator frame 150 after positioning the accumulator frame 150 on the upper end of the shell. At this time, the stationary shaft 300 is able to be coupled to the shell in the state of being centered with respect to the stator and the shell without any further centering work due to the clearance t1 even if there are machining clearance or deformation.

Figure 15:
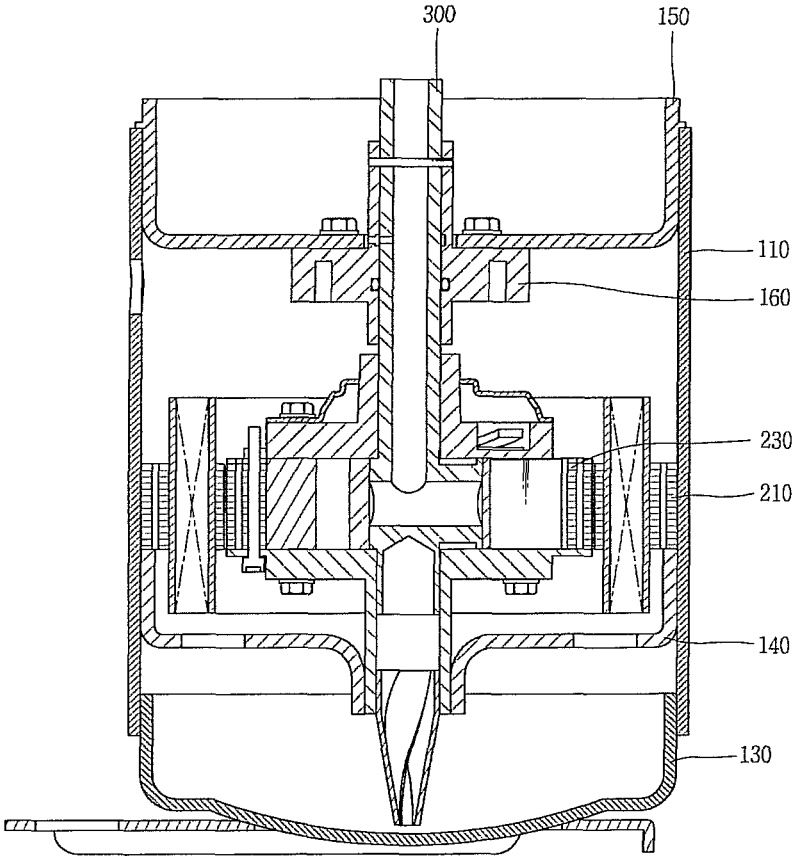
Figure 16:
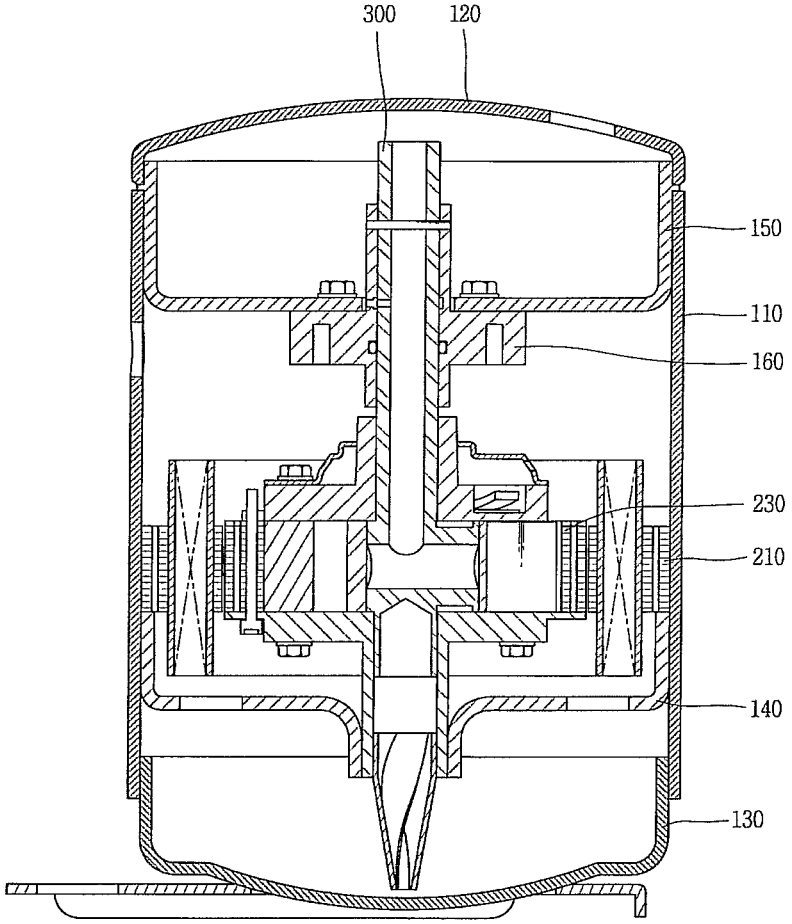

After the coupling of the stationary shaft, the lower cap and the upper cap are coupled to the lower end and upper end of the shell, respectively, thereby the inside space of the shell is sealed as shown in FIGS. 15 and 16.

The other basic configuration and working effect thereof in a hermetic compressor according to this embodiment as described above may be substantially the same as the foregoing embodiment.

What is claimed is:

1. A hermetic compressor, comprising:

a cylindrical shell;

a stator fixed to an inner surface of the shell;

a rotor rotatably installed with respect to the stator;

a compression device combined with the rotor to be rotated together with the rotor;

a stationary shaft including an eccentric portion around which the compression device is supported so as to be stationary with respect to a longitudinal direction thereof;

an accumulator fixed to an inside of the shell in such a manner as to seal an upper end of the shell and fixedly support a first end of the stationary shaft above the stator;

a lower frame fixed to the inside of the shell, that fixedly supports a second end of the stationary shaft;

an upper cap to seal an upper end of the accumulator; and a lower cap to seal a lower end of the shell, wherein the accumulator includes a cylindrical accumulator frame with an open upper end, wherein a circumferential wall portion of the accumulator frame rests on the upper end of the shell, and wherein the upper cap rests on the circumferential wall portion.

2. The hermetic compressor of claim 1, wherein the accumulator frame comprises a stationary end portion that protrudes from the circumferential wall portion, and wherein the stationary end portion contacts a circumferential end of the upper cap and a circumferential end of the shell.

3. The hermetic compressor of claim 2, wherein a portion of the circumferential wall portion of the accumulator is in contact with an inner surface of the shell and another portion of the circumferential wall portion is in contact with an inner surface of the upper cap.

4. The hermetic compressor of claim 3, wherein the shell, the upper cap, and the accumulator are fixed together by welding together the stationary end portion, the circumferential end of the upper cap, and the circumferential end of the shell.

5. The hermetic compressor of claim 1, wherein the lower ca is fixed to a lower portion of an inner circumferential surface of the shell.

6. The hermetic compressor of claim 1, wherein the compression device comprises:

a cylinder disposed to rotate around the eccentric portion; and main and sub bearings fixed to upper and lower surfaces of the cylinder, respectively, in order to form a space inside of the cylinder, wherein the main and sub bearings contact upper and lower surfaces of the eccentric portion, respectively.

7. The hermetic compressor of claim 1, further comprising a stationary bush engaged with an outer circumferential surface of the stationary shaft, wherein the stationary bush is fixed to the accumulator by being inserted into a bush hole formed in a bottom surface of the accumulator.

8. The hermetic compressor of claim 7, wherein an inner diameter of the bush hole is larger than an outer diameter of the stationary bush.

9. The hermetic compressor of claim 8, wherein a plurality of through holes are formed at a periphery of the bush hole, and a diameter of each of the plurality of through holes is larger than a diameter of a respective bolt which is fixed to the stationary bush through a respective through hole of the plurality of through holes.

10. The hermetic compressor of claim 7, wherein the stationary bush and the stationary shaft are coupled by a fixing pin.

11. The hermetic compressor of claim 1, wherein the accumulator frame comprises a stationary end portion that protrudes from the circumferential wall portion and a extended portion, which is bent from the stationary end portion, and wherein the upper cap is fixed to the accumulator in a state in which a circumferential end of the upper cap contacts the stationary end portion and an outer circumferential surface of the upper cap contacts an inner circumferential surface of the extended portion.

12. The hermetic compressor of claim 1, wherein the stationary shaft comprises a shaft portion coupled with and extending through the accumulator frame.

13. The hermetic compressor of claim 12, wherein an upper end portion of the shaft portion is disposed above the accumulator frame.

14. The hermetic compressor of claim 12, wherein a central longitudinal axis of the stationary shaft extends a predetermined distance from and in parallel to a central longitudinal axis of a suction pipe coupled to the upper cap.

15. The hermetic compressor of claim 1, wherein the accumulator frame forms an accumulator chamber, which is separated from an internal space of the shell by the accumulator frame, and wherein the accumulator frame is coupled to the stationary shaft to seal the accumulator chamber from the internal space of the shell.

16. The hermetic compressor of claim 1, wherein the stator and the lower frame are fixed to an inner circumferential surface of the shell by a shrink fit at the same time in state in which the stator rests on the lower frame.

17. The hermetic compressor of claim 1, wherein a first portion of an outer wall of the circumferential wall portion of the accumulator frame is disposed adjacent to an inner circumferential wall of shell, and a second portion of the outer wall of the circumferential wall portion of the accumulator frame is disposed adjacent to an inner circumferential wall of the upper cap.

18. The hermetic compressor of claim 17, further comprising a protrusion that extends from the outer wall of the circumferential wall portion of the accumulator frame, and wherein the protrusion rests on the upper end of the shell, and a lower end of the upper cap rests on the protrusion.

19. The hermetic compressor of claim 1, wherein a portion of an outer wall of the circumferential wall portion of the accumulator frame is disposed adjacent to an inner circumferential wall of the shell, and wherein a portion of an inner wall of the circumferential wall portion of the accumulator frame is disposed adjacent an outer circumferential wall of the upper cap.

20. The hermetic compressor of claim 1, wherein a suction pipe is coupled to the upper cap, and a discharge pipe is coupled to the shell.

* * * * *